US005279510A

United States Patent [19]

Remy

[11] Patent Number: 5,279,510

[45] Date of Patent: Jan. 18, 1994

[54] CUSHION FOR TOWABLE RIDING APPARATUS

[76] Inventor: Andrew P. Remy, 8220 Sandpiper Cir., Fort Worth, Tex. 76108

[21] Appl. No.: 950,062

[22] Filed: Sep. 23, 1992

[51] Int. Cl.[5] ..... B63B 1/00

[52] U.S. Cl. ..... 441/67; 441/129; 114/345

[58] Field of Search ..... 441/65-67, 129; 114/345, 346, 363

[56] References Cited

U.S. PATENT DOCUMENTS

| | | | |
|---|---|---|---|
| 1,960,474 | 5/1934 | Browne | 9/17 |
| 2,876,467 | 3/1959 | Lund | 9/11 |
| 3,628,206 | 12/1971 | Mecham | 114/346 |
| 3,871,042 | 3/1975 | Farmer | 9/1 |
| 4,451,239 | 5/1984 | Hoenstine et al. | 441/66 |
| 4,619,620 | 10/1986 | Felter | 441/66 |
| 4,689,844 | 9/1987 | Alivizatos | 5/455 |
| 5,122,086 | 6/1992 | Remy | 441/66 |

*Primary Examiner*—Edwin L. Swinehart
*Attorney, Agent, or Firm*—Geoffrey A. Mantooth

[57] ABSTRACT

A riding apparatus has an inflatable member, a cover and a cushion. The inflatable member has a cavity that has a top end and a bottom end. The cover has a bottom wall and side walls that form an enclosure for receiving the inflatable member. The cushion is located on the bottom wall so as to extend across the bottom end of the inflatable member cavity. A rider sitting in the cavity of the riding apparatus sits or kneels on the cushion. The cushion is secured inside of the cover by clamping the edge portions of the cushion between the inflatable member and the cover.

4 Claims, 1 Drawing Sheet

CUSHION FOR TOWABLE RIDING APPARATUS

FIELD OF THE INVENTION

The present invention relates to riding apparatuses in which human beings can ride in and which can be towed across the surface of water.

BACKGROUND OF THE INVENTION

Motorboats are widely used for towing people that ride on various devices. For example a toroidally shaped tube may be towed behind a motorboat, carrying a person on top. The prior art has developed covers for encasing these tubes. These covers, which are shown in U.S. Pat. Nos. 4,451,239 and 4,635,581 provide a means for attaching the tow rope from the motorboat and provide a closed bottom. The covering has an opening in the top, which opening allows the rider to sit inside the tube. The rider thus sits on the bottom of the cover. Prior art covers are typically made of a sheet-like material such as vinyl. The closed bottom of the prior art covers cause the tube to plane on top of the water and provide a supporting surface for the rider.

I have found that prior art covers suffer from the problem of providing an uncomfortable ride. Because the rider is separated from the water only by a thin sheet of vinyl material (the bottom of the cover), all of the forces exerted by the vinyl as the tube and cover are towed across the water are transmitted directly to the rider. Although some bumps may be desirable, with prior art covers many of the bumps experienced by a rider are "hard" shocks to the rider's body. For many people, these hard shocks diminish the enjoyment of riding in the riding apparatus.

SUMMARY OF THE INVENTION

It is an object of the present invention to provide a towable riding apparatus that cushions some of the hard shock forces for the rider.

The riding apparatus of the present invention includes an inflatable member, a cover and a cushion. The inflatable member forms a cavity, with the cavity having a top end and a bottom end. The cover has a bottom wall and side walls. The inflatable member is contained in the bottom and side walls of the cover with the bottom wall being located across the bottom end of the cavity. The cushion is located in the cavity and bears on the bottom wall.

In one aspect of the present invention, the cushion includes a sheet of flexible and resilient foam material. In another aspect of the present invention, the cushion is sized larger than the cavity bottom end so that the cushion has edges that are interposed between the bottom and side walls of the cover and the inflatable member. Thus, the edges of the cushion are pinched or clamped between the cover and the inflatable member, wherein the cushion is securely retained inside of the towing apparatus.

DESCRIPTION OF PREFERRED EMBODIMENT

Figure 1:
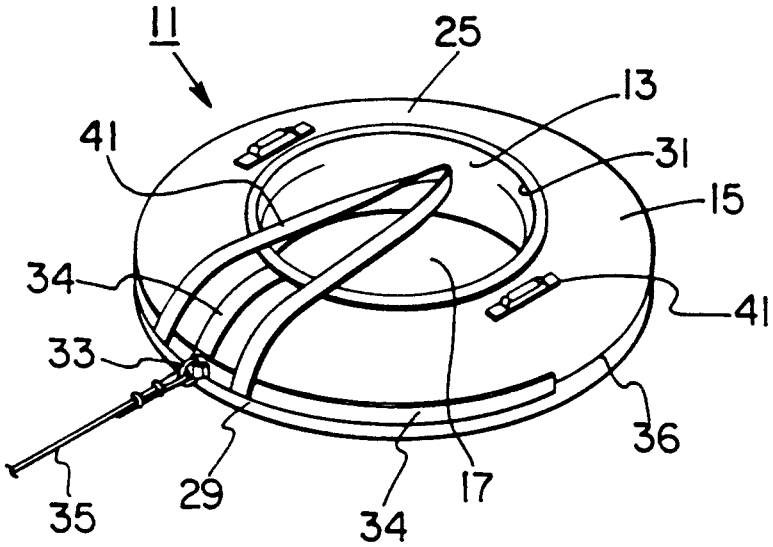
FIG. 1 is an isometric view showing the towable riding apparatus of the present invention, in accordance with a preferred embodiment.
Figure 3:
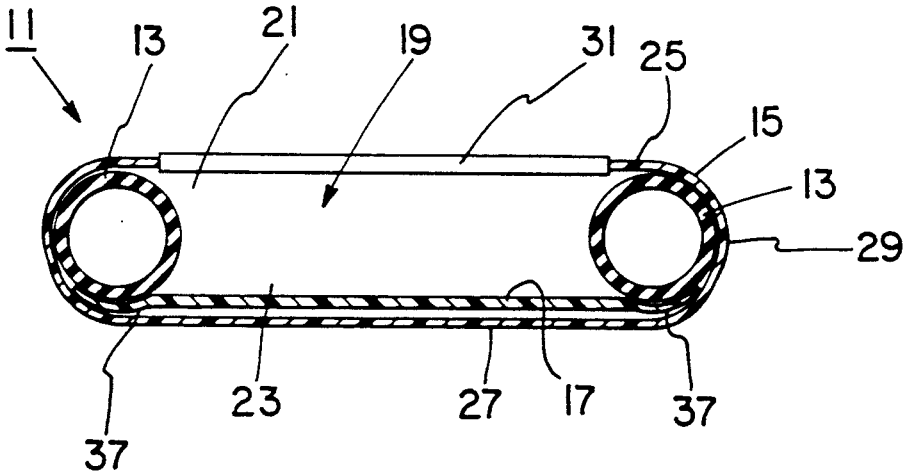
FIG. 3 is a cross sectional view of the apparatus of FIG. 1.

In FIGS. 1 and 3, there are shown views of the towable riding apparatus 11 of the present invention, in accordance with a preferred embodiment. The riding apparatus 11 includes an inflatable member 13, a cover 15 and a cushion 17.

The inflatable member 13 is a toroidally shaped tube such as is used in vehicle tires. The tube has a cavity 19 or opening therein. The cavity has a top end 21 and a bottom end 23. Such tubes are conventional and are commercially available.

The cover 15 has top, bottom and side walls 25, 27, 29. The cover 15 is made of a flat, sheet-like material that is flexible and durable, such as fourteen ounce vinyl. The top, bottom and side walls 25, 27, 29 form an enclosure for receiving the inflatable member. The top wall 25 has an opening 31 therein. The cover 15 also has a towing harness for the coupling of a towing rope 35. The harness has a metal ring 33 (either O-shaped or D-shaped) secured to the cover by webbing 34 that is stitched to the walls of the cover. The cover 15 and inflatable member 13 are described in more detail in my U.S. Pat. No. 5,122,086, entitled "Towable Riding Apparatus", the specification and drawings of which are incorporated herein by reference. In the preferred embodiment, the top, bottom and side walls are formed by stitching top and bottom members together at a seam 36 that is located along the side wall 29.

Figure 2:
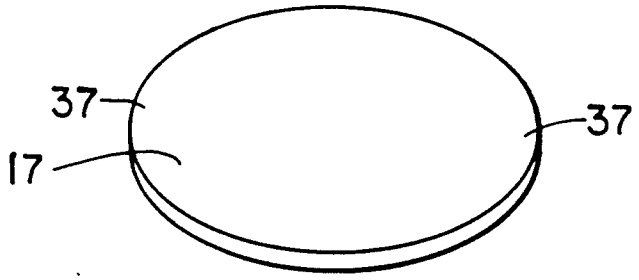
FIG. 2 is an isometric view of the cushion.

The cushion 17 is a sheet of foam material (see FIG. 2). The foam is flexible and resilient. In the preferred embodiment, the cushion is cross-linked polyethylene of two pound density. The foam sheet is three-eighths inches thick. The cushion is cut in the shape of a circular disk, so as to totally cover the circular bottom wall 27 of the cover 15. The cushion 17 has a diameter that is slightly less than the outside diameter of the inflatable member 13. Thus, the cushion is actually larger than the diameter of the bottom end 23 of the cavity 19. This ensures that the edge portions 37 of the cushion are pinched between the inflatable member 13 and the walls of the cover 15, wherein the cushion is secured inside of the cover.

To assemble the riding apparatus 11, the cover 15 is unfolded and spread out on the ground, with the bottom wall 27 in contact with the ground and the top opening 31 located on top. Next, the cushion 17 is inserted into the interior of the cover through the top opening 31. The cushion 17 is flattened out along the bottom wall 27 of the cover. Then, the inflatable member 13 (in a deflated condition) is inserted into the interior of the cover through the top opening 31. The inflatable member 13 is located on top of the cushion 17 and is spread out inside of the cover. Then, the inflatable member 13 is inflated with air through a fitting (not shown). When the inflatable member 13 is fully inflated, the cover 15 snugly fits around the inflatable member. Also, the edge portions 37 of the cushion are pinched between the inflatable member 13 and the cover 15. The side walls 29 and top walls 25 of the cover contact the inflatable member.

To use the riding apparatus 11, the riding apparatus is positioned on the water with the bottom wall 27 in contact with the water and the top wall 25 located above the water. A rider enters the cavity 19 through the top wall opening 31. The rider sits or kneels on top of the cushion 17, which in turn bears on the bottom wall 27 of the cover. The torso, head and arms of the rider are located above the cavity. One end of the tow rope 35 is secured to the riding apparatus at the ring 33, while the other end is secured to a motor boat. The rider grabs a handhold 41 on the cover 15 and is towed behind the motorboat.

As the riding apparatus 11 is towed, the bottom wall 27 of the cover planes across the surface of the water. The amount of bumpiness in the ride depends on the smoothness of the surface of the water and the speed at which the riding apparatus is towed. The cushion 17 serves to remove some of the bumpiness of the ride, as the rider sits directly on top of the cushion. The cushion 17 acts as a shock absorber to absorb sudden impact or "hard" shocks, thus providing protection to the rider. Furthermore, the cushion is firmly secured inside of the cover by virtue of its edges 37 being clamped between the cover and the inflatable member. Thus, in spite of the bumpiness of the ride, the cushion remains secured.

The cushion of the present invention can be used with riding apparatuses having one or more inflatable members. For example, the cushions could be used for the riding apparatus shown in my U.S. Pat. No. 5,122,086. A separate cushion would be provided for each inflatable member.

The foregoing disclosure and the showings made in the drawings are merely illustrative of the principles of this invention and are not to be interpreted in a limiting sense.

I claim:

1. A riding apparatus, comprising:

a) an inflatable member that forms a cavity, said cavity having a top end and a bottom end;

b) a flexible cover having a bottom wall and side walls;

c) said inflatable member being contained in said bottom and side walls of said cover with said bottom wall being located across said cavity bottom end;

d) a cushion located in said cavity and bearing on said bottom wall, said cushion being sized larger than said cavity bottom end, said cushion having edges that are clamped between said cover and said inflatable member.

2. The riding apparatus of claim 1 wherein said cushion comprises a sheet of flexible and resilient foam material.

3. A method of cushioning a riding apparatus, comprising:

a) providing an inflatable member that forms a cavity;

b) providing a flexible cover for said inflatable member;

c) installing a cushion in said cover through an opening in said cover;

d) installing said inflatable member in said cover and positioning said cushion so as to be located in said cavity while bearing on said cover;

e) securing said cushion by clamping an edge portion of said cushion between said inflatable member and said cover.

4. The method of claim 3 wherein said inflatable member is installed in said cover in a deflated condition, further comprising the step of after installing said inflatable member, inflating said inflatable member.

* * * * *